US009951617B2

(12) United States Patent
Kuramoto

(10) Patent No.: US 9,951,617 B2
(45) Date of Patent: Apr. 24, 2018

(54) TUNNEL BORING DEVICE, AND CONTROL METHOD THEREFOR

(71) Applicant: KOMATSU LTD., Tokyo (JP)

(72) Inventor: Toyoshi Kuramoto, Katano (JP)

(73) Assignee: KOMATSU LTD., Tokyo (JP)

( * ) Notice: Subject to any disclaimer, the term of this patent is extended or adjusted under 35 U.S.C. 154(b) by 133 days.

(21) Appl. No.: 15/023,036

(22) PCT Filed: Nov. 4, 2014

(86) PCT No.: PCT/JP2014/079264
§ 371 (c)(1),
(2) Date: Mar. 18, 2016

(87) PCT Pub. No.: WO2015/079872
PCT Pub. Date: Jun. 4, 2015

(65) Prior Publication Data

US 2016/0230553 A1 Aug. 11, 2016

(30) Foreign Application Priority Data

Nov. 29, 2013 (JP) ..... 2013-247696

(51) Int. Cl.
*E21D 9/11* (2006.01)
*E21D 9/10* (2006.01)

(52) U.S. Cl.
CPC ..... *E21D 9/1093* (2013.01); *E21D 9/108* (2013.01); *E21D 9/112* (2013.01)

(58) Field of Classification Search
CPC ..... E21D 9/003; E21D 9/108; E21D 9/1093; E21D 9/11; E21D 9/112
(Continued)

(56) References Cited

U.S. PATENT DOCUMENTS 4,436,448 A * 3/1984 Magnus ..... E21D 9/06 405/143
4,637,657 A * 1/1987 Snyder ..... E21D 9/1093 299/31
(Continued)

FOREIGN PATENT DOCUMENTS

CN 1068887 A 12/1979
CN 1068887 A 2/1993
(Continued)

OTHER PUBLICATIONS

The Office Action for the corresponding Chinese application No. 201480049384.4, dated Dec. 2, 2016.
(Continued)

*Primary Examiner* — David J Bagnell
*Assistant Examiner* — Michael A Goodwin
(74) *Attorney, Agent, or Firm* — Global IP Counselors, LLP

(57) ABSTRACT

A boring machine comprises a forward section, a rear section, an articulation point, a parallel link mechanism, an input component, an articulation point position computer, and a jack controller. The parallel link mechanism includes a plurality of thrust jacks that change the position of the forward section with respect to the rear section. The articulation point position computer computes the position of the articulation point on the basis of the control inputs received by the input component, and the positions of the center line and center point of the rear section and the center point of the forward section. The jack controller controls the stroke amounts of the thrust jacks to produce movement corresponding to a curve generated from the positions of the center point of the rear section, the articulation point, and the center point of the forward section.

12 Claims, 7 Drawing Sheets

(58) Field of Classification Search
USPC ..... 299/1.8
See application file for complete search history.

(56) References Cited

U.S. PATENT DOCUMENTS

| | | | | |
|---|---|---|---|---|
| 5,296,915 | A | 3/1994 | Akesaka | |
| 5,813,482 | A * | 9/1998 | Barbera | E21B 7/046 175/171 |
| 6,226,573 | B1 | 5/2001 | Okawa et al. | |
| 8,453,759 | B2 | 6/2013 | Saleniemi | |
| 2012/0230771 | A1 * | 9/2012 | Farley | B23P 19/02 405/184 |

FOREIGN PATENT DOCUMENTS

| | | | |
|---|---|---|---|
| CN | 1191616 | A | 8/1998 |
| CN | 101663464 | A | 3/2010 |
| CN | 102996137 | A | 3/2013 |
| JP | 61-266797 | A | 11/1986 |
| JP | 5-106390 | A | 4/1993 |
| JP | 8-165888 | A | 6/1996 |
| JP | 9-189190 | A | 7/1997 |
| JP | 10-25987 | A | 1/1998 |
| JP | 10-280871 | A | 10/1998 |
| JP | 2001311389 | A * | 11/2001 |

OTHER PUBLICATIONS

The International Search Report for the corresponding international application No. PCT/JP2014/079264, dated Dec. 22, 2014.

Development on Thrust Ram System for Tunnel Boring Machine (TBM) by Using Parallel Link by Shigeru Nishitake Fumihiko Ishise, Sirou Honmura, Akio Tanaka and Takeshi Matsuura in the Journal of Construction Management and Engineering by Japan Society of Civil Engineers Jun. 1996 No. 540 VI-31.

* cited by examiner

TUNNEL BORING DEVICE, AND CONTROL METHOD THEREFOR

CROSS-REFERENCE TO RELATED APPLICATIONS

This application is a U.S. National stage application of International Application No. PCT/JP2014/079264, filed on Nov. 4, 2014. This U.S. National stage application claims priority under 35 U.S.C. § 119(a) to Japanese Patent Application No. 2013-247696, filed in Japan on Nov. 29, 2013, the entire contents of which are hereby incorporated herein by reference.

BACKGROUND

Field of the Invention

The present invention relates to a tunnel boring device used in the excavation of a tunnel, and to a method for controlling this device.

Description of the Related Art

The excavation of a tunnel is performed using a boring machine equipped with a cutter head including a cutter at the front of the machine, and grippers provided on the left and right sides at the rear of the machine.

This boring machine excavates the tunnel by pressing the rotating cutter head against the working face in a state in which the left and right grippers have been pressed against the left and right side walls of the tunnel.

Japanese Laid-Open Patent Application S61-266797, for example, discloses a method for the directional control of an underground excavator, comprising a forward section having a cutter that performs rock excavation, and a rear section that has grippers for producing a counterforce for excavation, and that is linked via an actuator, etc., to the forward section.

With this underground boring machine, actuators (such as thrust jacks) are installed to allow bending between the forward section and the rear section, which makes the excavation of a curved tunnel possible.

Also, with the underground boring machine disclosed in Japanese Laid-Open Patent Application S61-266797, the operator has to adjust the attitude of the forward section by varying the stroke of the thrust jacks as needed, so that the excavated tunnel will not deviate from a stored planned excavation line even if the excavation is performed automatically on the basis of the planned excavation line and the direction in which the underground boring machine moves ends up changing due to a change in the hardness of rocks, etc.

Since the position and direction of the forward section require the three X, Y, and Z axes of a perpendicular coordinate system and movement with six degrees of freedom in the rotation of these axes, a six-axis drive link is necessary.

With one type of six-axis drive link, the rod side of six thrust jacks is linked to the forward section, and the cylinder tube side is linked to the rear section. A six-axis drive link such as this employs a so-called parallel link structure, in which the rod sides of a plurality of thrust jacks are disposed annularly near the outer peripheral edge of a face of the forward section that is opposite the forward section.

SUMMARY

However, the following problem was encountered with the conventional underground boring machine discussed above.

When a tunnel boring machine is used for shaft boring or the like, curved excavation with a smaller radius of curvature R than in ordinary tunnel excavation is required.

With a conventional tunnel boring machine, a curve is usually bored by forming an articulated tunnel by repeatedly changing the attitude of the forward section, which bores short distances in a straight line. Here, the attitude of the forward section of the tunnel boring device is varied by controlling the amount of thrust jack stroke based on the operators experience, but with the above-mentioned parallel link, the relation between the attitude and the amount of stroke may not match the operator's intuition, and this can make it difficult to control the device.

Also, when a sharply curved tunnel is built by repeatedly boring straight segments of a practical length, there is the risk that the articulated tunnel built by boring straight segments will deviate greatly from the desired sharply curved tunnel.

To put this another way, a problem encountered with a tunnel boring machine equipped with a conventional parallel link mechanism is that it is extremely difficult to excavate curved sections, particularly those with a small radius of curvature R, by manual operation.

It is an object of the present invention to provide a tunnel boring device with which excavation including curved portions can be performed by a simple operation, even when the tunnel excavation is performed by manual operation, as well as a method for controlling this device.

The tunnel boring device pertaining to a first exemplary embodiment of the present invention comprises a forward section, a rear section, an articulation point, a parallel link mechanism, an input component, a computer, and a jack controller. The forward section has a plurality of cutters at the excavation-side surface. The rear section is disposed to the rear of the forward section and has grippers for obtaining counterforce during excavation. The articulation point is provided between the forward section and the rear section. The parallel link mechanism includes a plurality of thrust jacks that are disposed in parallel between the forward section and the rear section, link the forward section and the rear section, and change the position of the forward section with respect to the rear section. The input component receives control inputs related to the movement direction of the forward section from an operator. The computer computes the position of the articulation point on the basis of the control input received by the input component, and the positions of the center line and center point of the rear section and the center point of the forward section. The jack controller controls the stroke of the thrust jacks included in the parallel link mechanism so that movement will correspond to a curve generated from the positions of the center point of the rear section, the articulation point, and the center point of the forward section.

Here, with a tunnel boring device in which a tunnel is excavated by moving a forward section with respect to a rear section by means of a parallel link mechanism that includes a plurality of thrust jacks provided between the forward section and the rear section, the forward section is moved forward along a curve generated from the positions of the center point of the rear section, a hypothetical articulation point found by computation, and the center point of the forward section.

With this tunnel boring device, the articulation point is provided between the forward section and the rear section. The forward section has a plurality of cutters installed at the distal end portion on the excavation side. The rear section is supported by grippers on the inner wall faces of the tunnel.

The parallel link mechanism has a plurality of (at least six) thrust jacks, and the position of the forward section with respect to the rear section, the attitude, and so forth can be controlled by deploying and retracting the thrust jacks according to preset target positions or target positions (directions) inputted by the operator.

The computer finds the position of the articulation point by computation on the basis of control inputs, the center line and center position of the rear section, and the center position of the forward section, so that boring is performed in a direction corresponding to the control input made by the operator. The center line and center position of the rear section can be obtained using the current position as a baseline. The center position of the forward section can be found by computation from the current position of the rear section, the stroke amounts of the thrust jacks, and so forth.

The jack controller controls the thrust jacks included in the parallel link mechanism so that the forward section moves along a curve expressing the computed movement direction on the basis of the articulation point found by computation, the center line and center position of the rear section, and the center position of the forward section.

Consequently, even when a change in rock properties, etc., during automatic operation along the preset desired curve should cause the movement direction of the forward section to deviate from the specified movement direction, the attitude of the forward section up to the target position can be controlled and excavation performed along a smooth curve merely by inputting the movement direction by means of manual operation from the operator (such as pressing a direction key so that the device advances to the right).

As a result, excavation can be carried out along the desired curve by simple operator control inputs, even with a tunnel boring device equipped with a parallel link mechanism that does not lend itself to intuitive operator control, particularly when performing excavation along a curve with a small radius of curvature R.

The tunnel boring device pertaining to a second exemplary embodiment of the present invention is the tunnel boring device pertaining to the first exemplary embodiment of the present invention, wherein, when the input component receives a control input from the operator, the jack controller controls the thrust jacks so that excavation is performed along the desired radius of curvature R set on the basis of the control input.

Here, excavation of a curved portion is performed along the desired radius of curvature R under control input from the operator.

Consequently, excavation along a smooth curve can be performed while maintaining the desired radius of curvature R by means of a single control input from the operator.

The tunnel boring device pertaining to a third exemplary embodiment of the present invention is the tunnel boring device pertaining to the first or second exemplary embodiments of the present invention, wherein the jack controller controls the attitude of the forward section three-dimensionally.

Here, the thrust jacks included in the parallel link mechanism are controlled so that the orientation and attitude of the forward section with respect to the rear section can be adjusted three-dimensionally (in the up, down, left, and right directions).

Consequently, the three-dimensional excavation of a tunnel that includes a curved portion can be easily carried out with just simple input components.

The tunnel boring device pertaining to a fourth exemplary embodiment of the present invention is the tunnel boring device pertaining to the first or second exemplary embodiment of the present invention, further comprising stroke sensors that are provided to the thrust jacks to sense the attitude of the forward section with respect to the rear section.

Here, stroke sensors installed on the respective thrust jacks are used to provide information for computing the position and attitude of the forward section with respect to the rear section.

Consequently, the position and orientation of the forward section with respect to the rear section can be easily sensed by sensing the stroke amounts of the thrust jacks from the sensing results of the stroke sensors.

The tunnel boring device pertaining to a fifth exemplary embodiment of the present invention is the tunnel boring device pertaining to the first or second exemplary embodiment of the present invention, wherein the input component is a touch panel type of monitor.

Here, a touch panel type of monitor is used as an input component that receives control inputs from the operator.

Consequently, when the operator adjusts the movement direction of the forward section by manual operation control, excavation can be easily performed in the desired direction merely by using the touch panel monitor.

The tunnel boring device pertaining to a sixth exemplary embodiment of the present invention is the tunnel boring device pertaining to the fifth exemplary embodiment of the present invention, wherein the monitor has directional keys for setting the movement direction of the forward section, and a display component that displays the amount of deviation between the current position and the target position.

Here, the amount of deviation between the target position, the current position, and the directional keys that set the movement direction of the forward section is disposed on the touch panel monitor.

Consequently, the operator can easily excavate in the desired direction merely by looking at how the deviation changes, while intuitively pressing the directional key in which fine adjustment is needed.

The method for controlling a tunnel boring device pertaining to a seventh exemplary embodiment of the present invention is a method for controlling a tunnel boring device comprising a forward section, a rear section that is disposed to the rear of the forward section, an articulation point provided between the forward section and the rear section, and a parallel link mechanism that includes a plurality of thrust jacks that are disposed in parallel between the forward section and the rear section. The method comprises the following steps: receiving control inputs related to the movement direction of the forward section from an operator, computing the position of the articulation point on the basis of the positions of the center line and center point of the rear section and the center point of the forward section, and controlling the stroke amounts of the thrust jacks included in the parallel link mechanism so that movement will correspond to a curve generated from the positions of the center point of the rear section, the articulation point, and the center point of the forward section.

Here, with a tunnel boring device that performs tunnel excavation by moving the forward section with respect to the rear section by means of a parallel link mechanism that includes a plurality of thrust jacks provided between the forward section and the rear section, the forward section is moved forward along a curve generated from the positions of the center point of the rear section, the articulation point found by computation, and the center point of the forward section.

With this method for controlling a tunnel boring device, a hypothetical articulation point is provided between the forward section and the rear section. The parallel link mechanism has a plurality of (at least six) thrust jacks, and the position of the forward section with respect to the rear section, the attitude, and so forth can be controlled by deploying and retracting the thrust jacks according to preset target positions or target positions (directions) inputted by the operator.

The position of the articulation point is found by computation on the basis of control inputs, the center line and center position of the rear section, and the center position of the forward section, so that excavation is performed in a direction corresponding to the control inputs by the operator. The center line and center position of the rear section can be obtained using the current position as a baseline. The center position of the forward section can be found by computation from the current position of the rear section, the stroke amounts of the thrust jacks, and so forth.

The thrust jacks included in the parallel link mechanism are controlled so that the forward section moves along a curve expressing the computed movement direction on the basis of the articulation point found by computation, the center line and center position of the rear section, and the center position of the forward section.

Consequently, even when a change in rock properties, etc., during automatic operation along the preset desired curve should cause the movement direction of the forward section to deviate from the specified movement direction, the attitude of the forward section up to the target position can be controlled and excavation performed along a smooth curve merely by inputting the movement direction by means of manual operation from the operator (such as pressing a direction key so that the device advances to the right).

As a result, excavation can be carried out along the desired curve by simple operator control inputs, even with a tunnel boring device equipped with a parallel link mechanism that does not lend itself to intuitive operator control, particularly when performing boring along a curve with a small radius of curvature R.

The method for controlling a tunnel boring device pertaining to an eighth exemplary embodiment of the present invention is a method for controlling a tunnel boring device comprising a rear section and a forward section that has a cutter head and is linked to the rear section so as to allow movement of the relative position with respect to the rear section. The method comprises the steps of indicating the position of the forward section with respect to the position of the rear section, computing the position of the articulation point, which is the intersection between the center line of the forward section and the center line of the rear section, generating a curve that smoothly connects three points, namely, the position of the forward section, the position of the articulation point, and the position of the rear section, and moving the forward section with respect to the rear section along the curve.

With a tunnel boring device that excavates a tunnel by moving a forward section with respect to a rear section, the forward section is moved forward along a curve generated from the positions of the center point of the rear section, a hypothetical articulation point found by computation, and the center point of the forward section.

With this method for controlling a tunnel boring device, a hypothetical articulation point is provided between the forward section and the rear section. The position of the articulation point is found by computation on the basis of control inputs, the center line and center position of the rear section, and the center position of the forward section, so that boring is performed in a direction corresponding to the control inputs by the operator. The center line and center position of the rear section can be obtained using the current position as a baseline. The center position of the forward section can be found by computation from the current position of the rear section, the stroke amounts of the thrust jacks linking the forward section and rear section, and so forth.

Consequently, even when a change in rock properties, etc., during automatic operation along the preset desired curve should cause the movement direction of the forward section to deviate from the specified movement direction, the attitude of the forward section up to the target position can be controlled and excavation performed along a smooth curve merely by inputting the movement direction by means of manual operation from the operator (such as pressing a direction key so that the device advances to the right).

As a result, excavation can be carried out along the desired curve by simple operator control inputs, even with a tunnel boring device equipped with a parallel link mechanism that does not lend itself to intuitive operator control, particularly when performing excavation along a curve with a small radius of curvature R.

With the tunnel boring device pertaining to the exemplary embodiments of the present invention, excavation including a curved portion can be performed by a simple operation even when excavating a tunnel by manual operation.

DETAILED DESCRIPTION OF EXEMPLARY EMBODIMENTS

The tunnel boring device pertaining to an exemplary embodiment of the present invention, and the method for controlling this device, will now be described through reference to FIGS. 1 to 7.

The boring machine (tunnel boring device) 10 in this exemplary embodiment (FIG. 1, etc.) is an excavation device used in shaft boring (see FIG. 7), and is called a TBM (tunnel boring machine), or more precisely, a gripper TBM or a hard rock TBM. Also, in this exemplary embodiment, the tunnel (first tunnel T1) excavated by the boring machine 10 has a substantially circular cross section (see the first tunnel T1 in FIG. 2). The cross sectional shape of the tunnel excavated by the boring machine 10 pertaining to this exemplary embodiment is not limited to being circular, and may instead be elliptical, double circular, horseshoe shaped, or the like.

Configuration of Boring Machine 10

Figure 1:
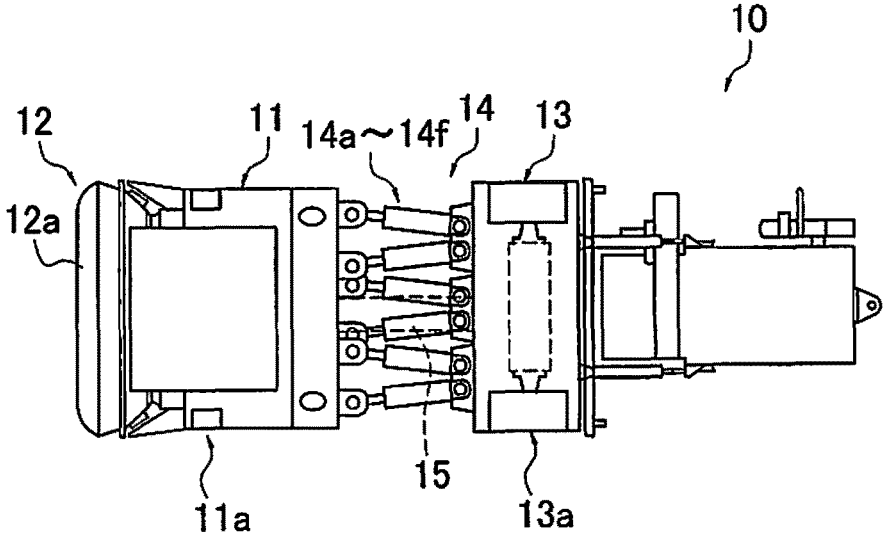
FIG. 1 is an overall view of the configuration of the tunnel boring device pertaining to an exemplary embodiment of the present invention.

In this exemplary embodiment, the excavation of the first tunnel T1 (see FIG. 2, etc.) was performed using the boring machine 10 shown in FIG. 1. The boring machine 10 described in this exemplary embodiment has an ordinary configuration for performing excavation by rotating a cutter head 12 while supported to the rear by grippers 13*a*.

The boring machine 10 is a device used to excavate a first tunnel T1 by moving forward while excavating a rock, etc., and as shown in FIG. 1, comprises a forward section 11, a cutter head 12, a rear section 13, a parallel link mechanism 14, and a conveyor belt 15.

Figure 2:
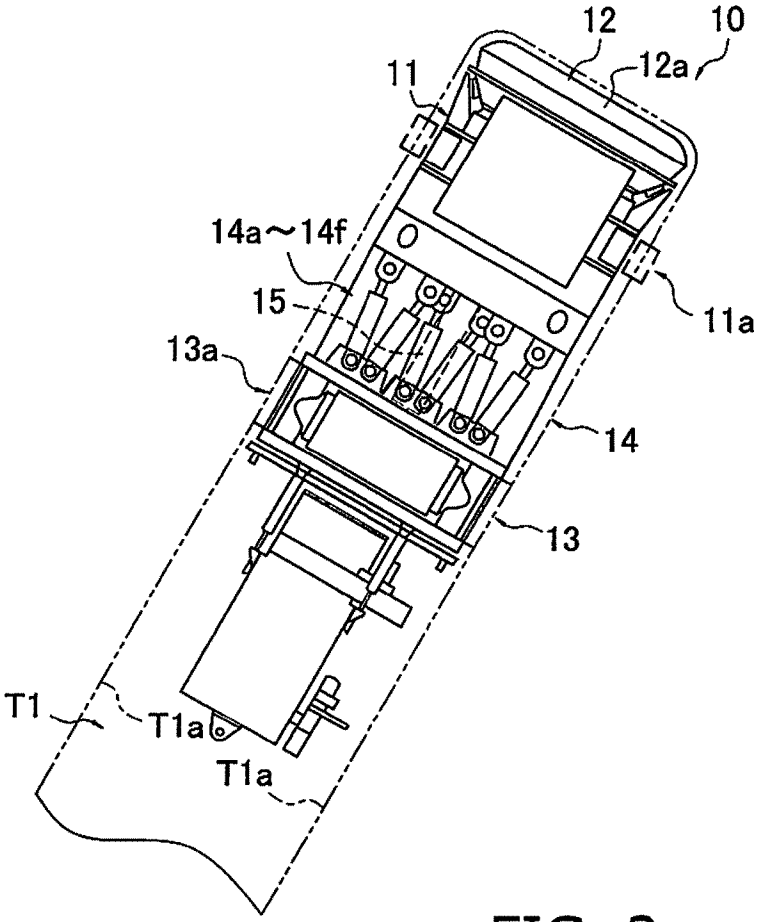
FIG. 2 is a cross section of the state of performing tunnel excavation using the boring machine in FIG. 1.

As shown in FIG. 1, the forward section 11 is disposed between the cutter head 12 and the parallel link mechanism 14, and constitutes the front part of the boring machine 10 along with the cutter head 12 provided to the distal end on the excavation side. The position and attitude of the forward section 11 with respect to the rear section 13 are changed by a plurality of thrust jacks 14*a* to 14*f* included in the parallel link mechanism 14 (discussed below). As shown in FIG. 2, the forward section 11 also has grippers 11*a* that protrude from the outer faces of the forward section 11 and are pressed against side walls T1*a* of the tunnel T1. Consequently, when the boring machine 10 is reversed, for example, the forward section 11 is supported within the tunnel T1 while driven in the direction in which the parallel link mechanism 14 is extended, which allows the rear section 13 to be reversed.

As shown in FIG. 1, the cutter head 12 is disposed on the distal end side of the boring machine 10, and is rotated such that its rotational center is the center axis of the substantially circular tunnel, and rock, etc., is excavated by a plurality of disk cutters 12*a* provided to the surface on the distal end side. Rocks, stones, and the like that have been finely crushed by the disk cutters 12*a* are brought into the interior of the cutter head 12 through openings (not shown) formed in the surface.

As shown in FIG. 1, the rear section 13 is disposed on the rear side of the boring machine 10, and constitutes the rear part of the boring machine 10. Grippers 13*a* are provided on both sides of the rear section 13 in the width direction. The rear section 13 and the forward section 11 are linked by the parallel link mechanism 14.

As shown in FIG. 2, the grippers 13*a* protrude outward in the radial direction from the outer faces of the rear section 13, and are thereby pressed against the side walls T1*a* of the first tunnel T1 during excavation. This allows the boring machine 10 to be supported within the first tunnel T1.

As shown in FIG. 1, the parallel link mechanism 14 is disposed in the middle of the boring machine 10 in the longitudinal direction, and constitutes the middle section of the boring machine 10. The parallel link mechanism 14 has six thrust jacks 14*a* to 14*f*, which are hydraulic actuators. Therefore, the thrust jacks 14*a* to 14*f* are extended and retracted between the forward section 11 and the rear section 13 so that the attitude (orientation) of the forward section 11 with respect to the rear section 13 is controlled to the desired direction while the first tunnel T1 is excavated by the cutter head 12.

The six thrust jacks 14*a* to 14*f* are disposed in parallel as links between the forward section 11 and the rear section 13, and link the forward section 11 to the rear section 13. The rod side and cylinder tube side of the six thrust jacks 14*a* to 14*f* are disposed along the outer peripheral portion on the opposing faces of the forward section 11 and the rear section 13. When the thrust jacks 14*a* to 14*f* are extended and retracted, the forward section 11 is moved forward with respect to the rear section 13, or the rear section 13 is reversed with respect to the forward section 11, allowing the boring machine 10 to be moved forward and backward a little at a time.

With the boring machine 10 in this exemplary embodiment, which comprises the parallel link mechanism 14 including the thrust jacks 14*a* to 14*f*, operation can be difficult because the relation between the stroke amounts of the thrust jacks 14*a* to 14*f* and the actual attitude of the forward section 11 may not match the intuition of the operator. A particularly difficult job is the manually-operated excavation of a curved portion with a small radius of curvature R.

In this exemplary embodiment, the excavation of the desired curved portion can be easily carried out merely by making a simple input operation by executing effective control during excavation that entails a sharply curved portion such as this that is so difficult. The method for controlling the boring machine 10 to accomplish this will be discussed in detail below.

The conveyor belt 15 is provided between the forward section 11 and the rear section 13, and is used to convey rock, sand, or the like excavated by the cutter head 12 from the forward section 11 to the rear section 13.

A hypothetical articulation point Px (see FIG. 4), which serves as the inflection point of the boring machine 10 in the longitudinal direction, is located near this conveyor belt 15. Accordingly, when the boring machine 10 moves forward along the desired curve, the stroke amounts of the thrust jacks 14*a* to 14*f* is adjusted to put the forward section 11 at an angle to the rear section 13, with the inflection point being the hypothetical articulation point Px, and this allows excavation to proceed in directions other than straight ahead.

Because of the above configuration, the grippers 13*a* are pressed against the side walls T1*a* of the first tunnel T1, so that the boring machine 10 is supported and does not move within the first tunnel T1, and in this state, the thrust jacks 14*a* to 14*f* of the parallel link mechanism 14 are extended while the cutter head 12 at the distal end is rotating, so that the device moves forward while excavating rocks, etc. Here, with the boring machine 10, finely crushed rocks and so forth are conveyed to the rear on a conveyor belt or the like. In this way the boring machine 10 is able to bore through the first tunnel T1 (see FIG. 2).

Control Blocks of Boring Machine 10

Figure 3:
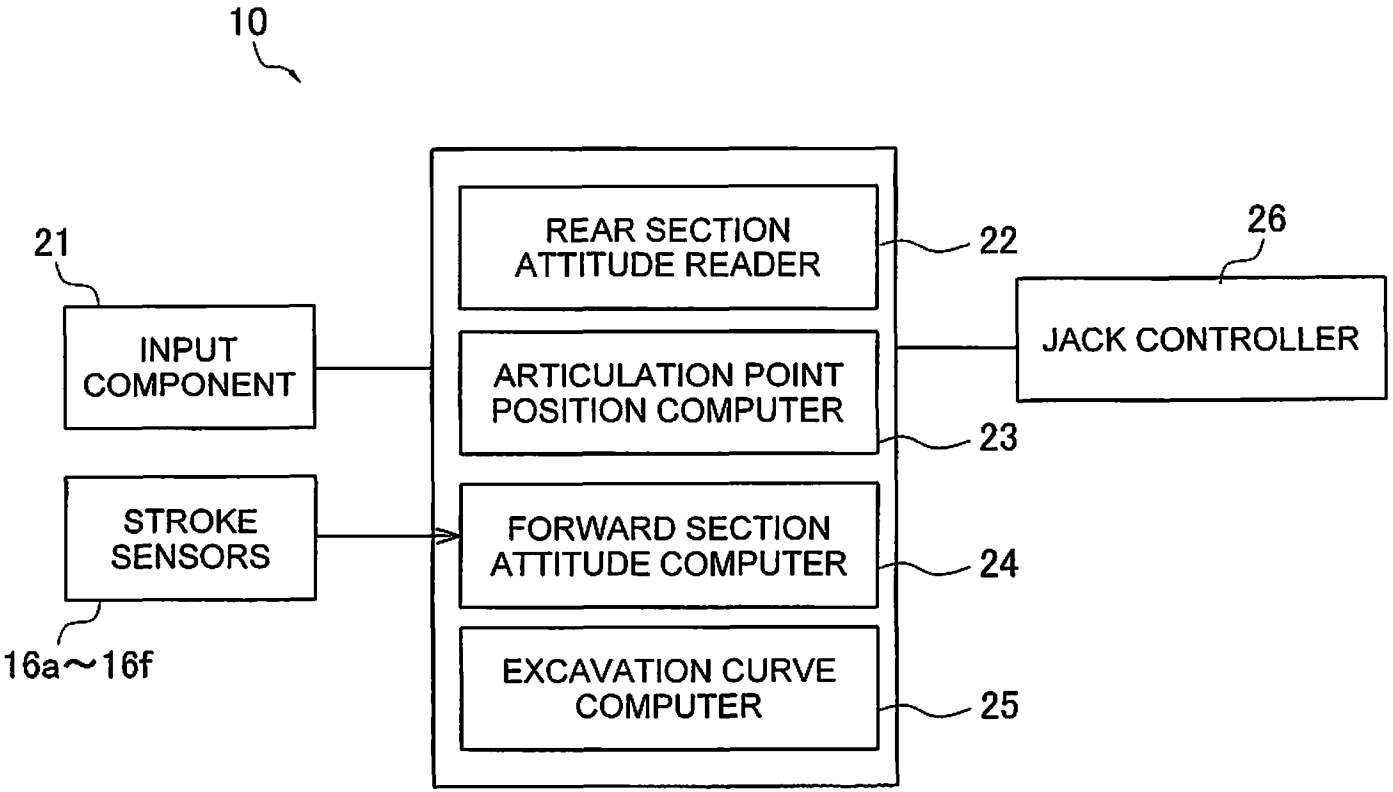
FIG. 3 is a control block diagram of the boring machine in FIG. 1.

As shown in FIG. 3, the boring machine 10 in this exemplary embodiment is made up of internal control blocks that include an input component 21, a rear section attitude reader 22, an articulation point position computer 23, a forward section attitude computer 24, an excavation curve computer 25, and a jack controller 26.

The input component 21 receives control inputs from the operator through a touch panel type of monitor display screen 50 (see FIG. 5) (discussed below). More specifically, when the direction in which the forward section 11 excavates (advances) is controlled manually, various keys 52*a* to 52*d* of a direction input component 52 (see FIG. 5), etc., are used.

The rear section attitude reader 22 finds the center position P1 and the center line C1 (orientation) of the rear section 13 from its current position (the position of the grippers 13*a*, etc.) (see FIG. 4). The center position P1 and the center line C1 of the rear section 13 can be found by external measurement made using a three-point prism (not shown) once a day, for example.

The articulation point position computer 23 computes the position of the hypothetical articulation point Px (see FIG.

4) on the basis of position information about the center position P1 and the center line C1 of the rear section 13 found by the rear section attitude reader 22, and information related to the target position to which the forward section 11 is supposed to move.

The forward section attitude computer 24 computes the center position P2 and attitude (center line C2) of the forward section 11 with respect to the rear section 13 on the basis of position information about the center position P1 and the center line C1 of the rear section 13 found by the rear section attitude reader 22, and the stroke amounts of the thrust jacks 14*a* to 14*f*. More specifically, as shown in FIG. 3, the forward section attitude computer 24 is connected to stroke sensors 16*a* to 16*f* respectively attached to the thrust jacks 14*a* to 14*f*, and acquires the stroke amounts of the thrust jacks 14*a* to 14*f*. This allows the forward section attitude computer 24 to obtain information related to the stroke amounts of the thrust jacks 14*a* to 14*f*, which are necessary in computing the position and attitude of the forward section 11.

Figure 4:
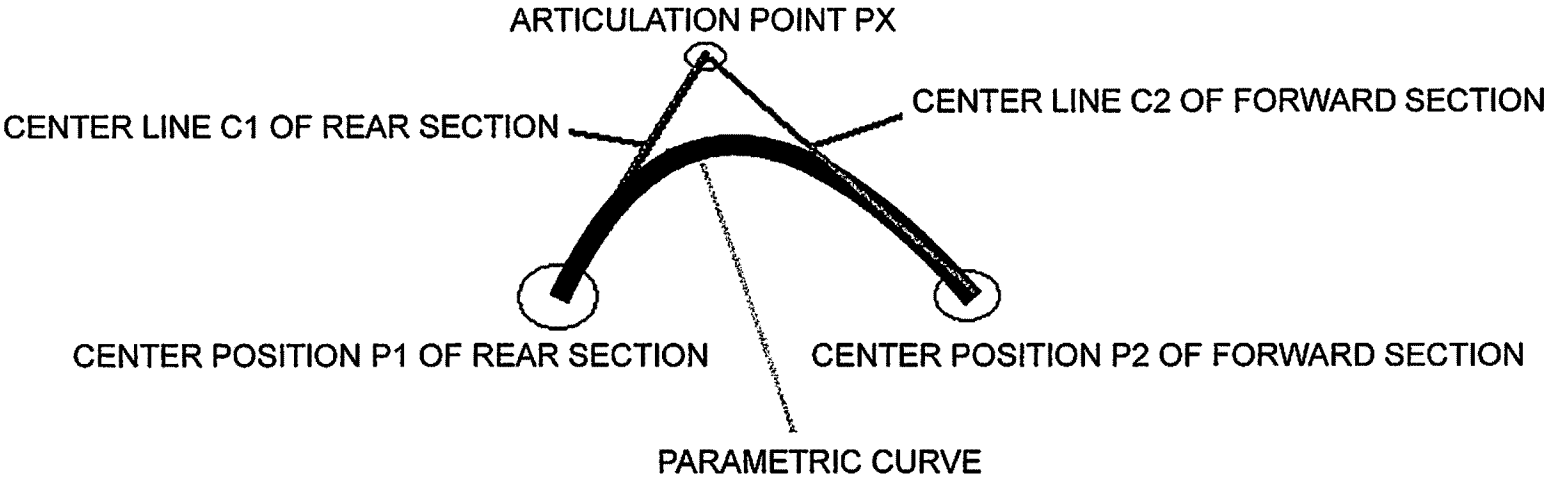
FIG. 4 is a diagram illustrating the curve used in controlling the boring machine in FIG. 1.

As shown in FIG. 4, the excavation curve computer 25 computes a smooth, three-dimensional curve that links the center position P1 of the rear section 13 and the center position P2 of the forward section 11 on the basis of information related to the center position P1 and the center line C1 of the rear section 13, position information related to the hypothetical articulation point Px, and information related to the center position P2 of the forward section 11, which serves as the target position corresponding to the manual operation by the operator.

This curve is a parametric curve that has three control points, namely, the above-mentioned center position P1 of the rear section 13, the center position P2 of the forward section 11, and the articulation point Px, and is tangent to the center line C1 of the rear section 13 and the center line C2 of the forward section 11. The parametric curve in this exemplary embodiment is a quadratic Bézier curve.

Specifically, in this exemplary embodiment, a three-dimensional arc trajectory can be accurately approximated using the center position P1 of the rear section 13 as the first control point, the articulation point Px as the second control point, and the center position P2 of the forward section as the third control point. Thus, the trajectory (target value) of three-dimensional working with a radius of curvature R can be computed with one-dimensional parameter changes by using the second control point as the articulation center. As a result, the target position can be set as points on the same parametric curve during linear excavation and during excavation along a curve that includes a small radius of curvature.

The jack controller 26 controls the stroke amounts of the thrust jacks 14*a* to 14*f* included in the parallel link mechanism 14 so that the forward section 11 will perform excavation along the Bézier curve computed by the excavation curve computer 25.

This allows excavation along a smooth curve (a quadratic Bézier curve) to be performed by the operator with just a simple input operation.

Monitor Display Screen 50

Figure 5:
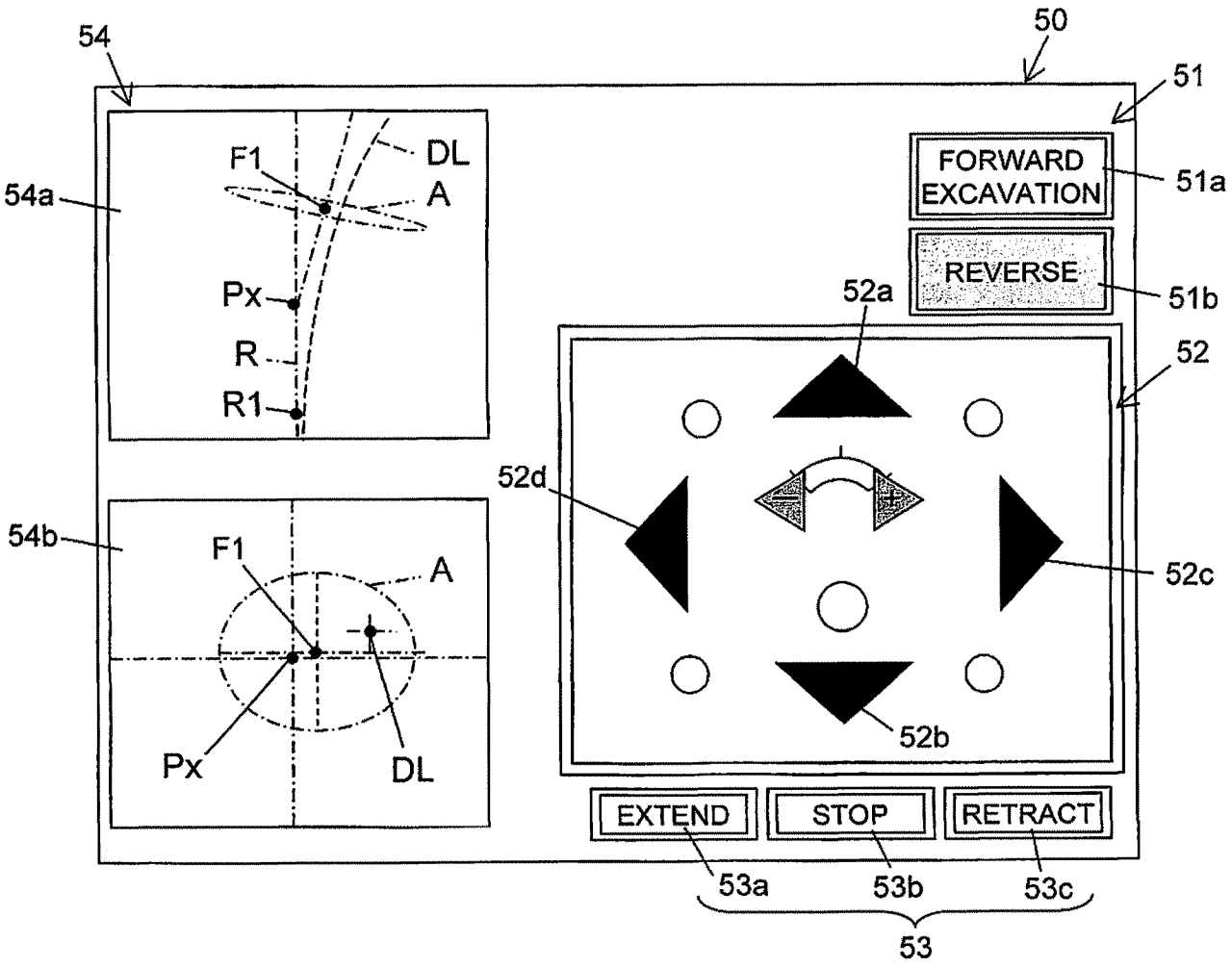
FIG. 5 is a diagram of the display screen of a monitor used for making control inputs to the boring machine in FIG. 1.

As shown in FIG. 5, the boring machine 10 in this exemplary embodiment makes use of a touch panel type of monitor display screen 50 as the input component 21 that receives control inputs from the operator. In this exemplary embodiment, as the interface for inputting the excavation target position, three points in the up and down direction, the left and right direction, and the forward direction can be inputted through the monitor display screen 50.

As shown in FIG. 5, a forward and reverse excavation setting component 51, the direction input component 52, a jack control component 53, and a deviation amount display component 54 are displayed on the monitor display screen 50.

The forward and reverse excavation setting component 51 is a switch for switching the movement direction (forward and reverse) of the boring machine 10, and has a forward excavation button 51*a* and a reverse excavation button 51*b*.

The forward excavation button 51*a* is pressed to make the boring machine 10 go forward. When the forward excavation button 51*a* is pressed, the cutter head 12, the grippers 13*a* of the rear section 13, and the parallel link mechanism 14 are controlled so that the boring machine 10 will move forward.

The reverse excavation button 51*b* is pressed to make the boring machine 10 reverse along the tunnel when tunnel excavation up to the desired position is complete, etc. When the reverse excavation button 51*b* is pressed, the grippers 13*a* of the rear section 13 and the parallel link mechanism 14 are controlled so that the boring machine 10 will move rearward.

The direction input component 52 is operated by the operator when deviation occurs in the progress of excavation toward the target position, and has a plurality of directional buttons (an up button 52*a*, a down button 52*b*, a right button 52*c*, and a left button 52*d*).

The up button 52*a*, down button 52*b*, right button 52*c*, and left button 52*d* are pressed in the direction of reducing the amount of deviation while the operator looks at the deviation amount display component 54 and checks the direction in which the deviation is occurring. Consequently, the operator can control the boring machine 10 so that it excavates toward the target position, merely by intuitively operating buttons in the direction of eliminating the deviation.

The jack control component 53 is a control input component for setting the operation of the six thrust jacks 14*a* to 14*f* included in the parallel link mechanism 14, and has an extend button 53*a*, a stop button 53*b*, and a retract button 53*c*.

The extend button 53*a* is used to drive the thrust jacks 14*a* to 14*f* in the direction in which they extend.

The stop button 53*b* is used to stop the movement of the thrust jacks 14*a* to 14*f*.

The retract button 53*c* is used to drive the thrust jacks 14*a* to 14*f* in the direction in which they retract.

The deviation amount display component 54 displays the position and attitude of the forward section 11 with respect to the rear section 13, as well as how much the forward section 11 of the boring machine 10 in the midst of excavation has currently deviated from the target position. The deviation amount display component 54 has a first display component 54*a* and a second display component 54*b*.

The first display component 54*a* displays the center position R1 and center line R of the rear section 13, the center position F1, center line F, and outline (attitude) A of the forward section 11, the articulation point Px of the excavation device, and the planned excavation line DL, which is a preset desired curved. The first display component 54*a* displays the direction in which the center position (forward section origin) F1 of the forward section 11 is deviating, using the articulation point Px as a reference. In the example shown in FIG. 5, the center position of the forward section 11 is shown to be deviating to the right. The first display component 54*a* also shows the deviation of the forward section center position F1 from the planned excavation line DL. In FIG. 5, the planned excavation line DL is displayed deviating to the right in order to make the drawing easier to see.

The second display component 54*b* displays the direction in which the center position of the forward section 11 is deviating in front view (up, down, left, or right), using the articulation point Px as the center position. In the example shown in FIG. 5, the center position of the forward section 11 is shown deviating to the right and slightly upward with respect to the center position of the rear section 13.

In this exemplary embodiment, the following operation can be performed when the operator sends a control input to the monitor display screen 50 shown in FIG. 5.

More specifically, when the forward excavation button 51*a* is ON and the extend button 53*a* is pressed, the grippers 13*a* of the rear section 13 are deployed toward the side walls of the tunnel, the grippers 11*a* of the forward section 11 are not deployed, and the thrust jacks 14*a* to 14*f* of the parallel link mechanism 14 are driven in the direction in which they extend. This allows just the forward section 11 to move forward, while the rear section 13 remains in the same position.

When the forward excavation button 51*a* is ON and the retract button 53*c* is pressed, the grippers 13*a* of the rear section 13 are not deployed, and the grippers 11*a* of the forward section 11 are deployed toward the side walls, and in this state the thrust jacks 14*a* to 14*f* of the parallel link mechanism 14 are driven in the direction in which they retract. This allows the position of the rear section 13 to be moved forward in the excavation direction, while the forward section 11 remains in the same position.

Furthermore, when the reverse excavation button 51*b* is ON and the extend button 53*a* is pressed, the grippers 13*a* of the rear section 13 are not deployed, and the grippers 11*a* of the forward section 11 are deployed, and in this state the thrust jacks 14*a* to 14*f* of the parallel link mechanism 14 are driven in the direction in which they extend. This allows just the rear section 13 to be reversed, while the forward section 11 remains in the same position.

When the reverse excavation button 51*b* is ON and the retract button 53*c* is pressed, the grippers 13*a* of the rear section 13 are deployed, and the grippers 11*a* of the forward section 11 are not deployed, and in this state the thrust jacks 14*a* to 14*f* of the parallel link mechanism 14 are driven in the direction in which they retract. This allows just the forward section 11 to be reversed, while the rear section 13 remains in the same position.

Method for Controlling Boring Machine 10

Figure 6:
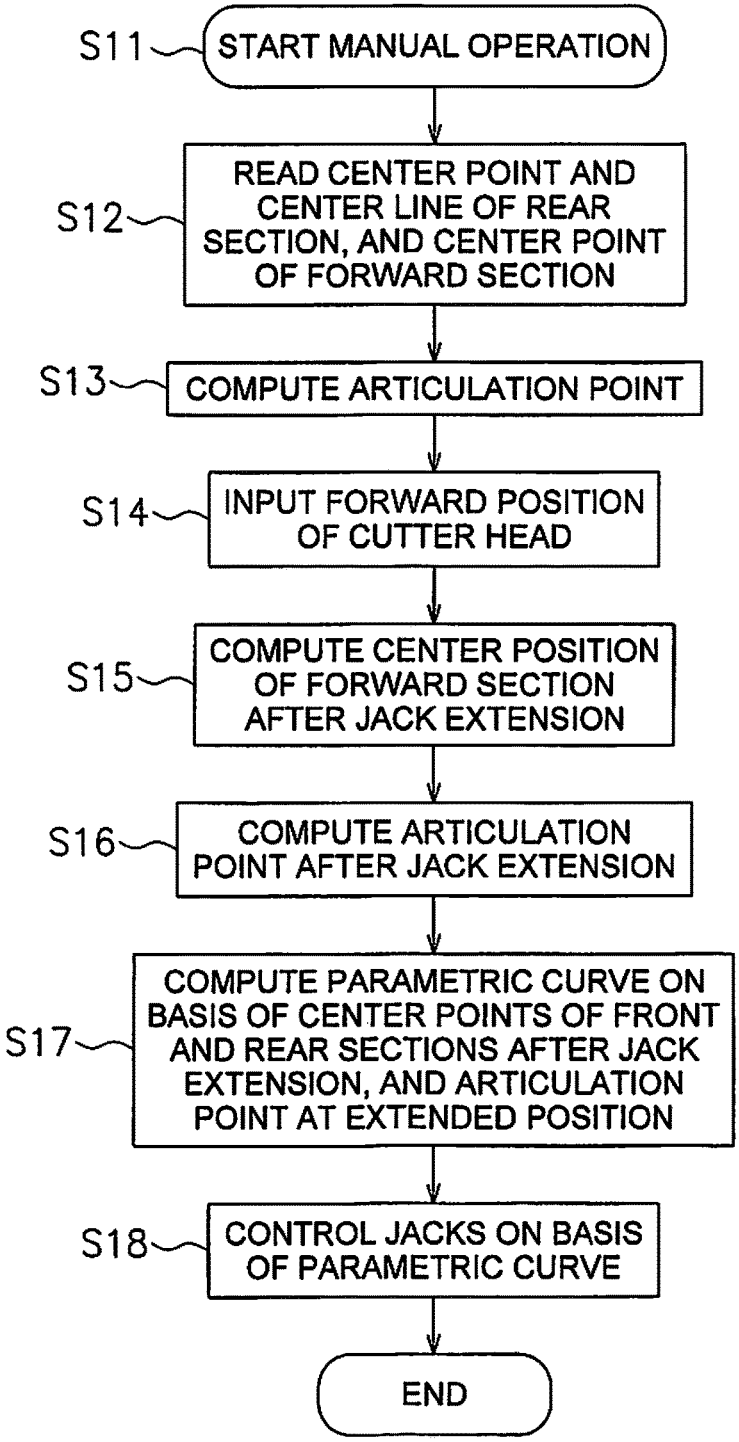
FIG. 6 is a flowchart of manual excavation control during tunnel excavation with the boring machine in FIG. 1.

The method for controlling the boring machine 10 in this exemplary embodiment will now be described through reference to the flowchart in FIG. 6.

With the boring machine 10 in this embodiment, when a change in the rock characteristics or the like causes the amount of deviation displayed on the deviation amount display component 54 shown in FIG. 5 to exceed a specific amount during automatic excavation operation along a curve set on the basis of a design diagram, for example, the operator manually operates the direction input component 52 so that the excavation will be performed toward the target position.

More specifically, first, in step S11 the control of the boring machine 10 is commenced by manual control input, and then in step S12 the center line C1 and the position of the center position P1 of the rear section 13 are found from the current position of the rear section 13. The center position of the forward section 11 is then found from the amounts of stroke of the thrust jacks 14*a* to 14*f* included in the parallel link mechanism 14 and from information about the center line C1 and the center position P1 of the rear section 13.

The amounts of stroke of the thrust jacks 14*a* to 14*f* can be acquired from the stroke sensors 16*a* to 16*f* (see FIG. 3) respectively attached to the thrust jacks 14*a* to 14*f*. The stroke sensors 16*a* to 16*f* are position sensors that sense the position (stroke) of the piston rods with respect to the cylinder tubes.

Next, in step S13, the articulation point Px is computed on the basis of information about the center position P2 of the forward section 11 and information about the center line C1 and the center position P1 of the rear section 13 found in step S12.

Next, in step S14, the operator uses the various directional buttons (the up button 52*a*, the down button 52*b*, the right button 52*c*, and the left button 52*d*) of the direction input component 52 to input the target position of the cutter head 12 (the forward section 11).

The directional buttons can be repeatedly pressed by the operator to set the target position in the desired direction.

Next, in step S15, the center position P2 of the forward section 11 is computed in a state in which the thrust jacks 14*a* to 14*f* of the parallel link mechanism 14 have been extended.

Next, in step S16, the position of the articulation point Px in a state in which the thrust jacks 14*a* to 14*f* of the parallel link mechanism 14 have been extended is computed from the current center position P1 of the rear section 13 and the center position P2 of the forward section 11 computed in step S15.

Next, in step S17, a parametric curve in which the control points are the center position P2 of the forward section 11, the center position P1 of the rear section 13, and the articulation point Px in a state in which the thrust jacks 14*a* to 14*f* have been extended, as found in steps S15 and S16, is computed on the basis of these three points in three-dimensional space.

More specifically, the parametric curve is a quadratic Bézier curve $P_{12}$ expressed by a quadratic equation of a parameter t, and can be found from the following relational formula (1).

$$P_{12}(t)=(1-t)^2P_0+2(1-t)tP_1+t^2P_2 \quad (1)$$

Here, the control point $P_0$ is the center position P1 of the rear section 13, $P_1$ is the articulation point Px, and $P_2$ is the center position P2 of the forward section 11. $P_1$, Px, and $P_2$ are three-dimensional spatial coordinates. The Relational Formula 1 produces a quadratic equation that passes through three-dimensional space and has a single peak.

Consequently, in the jack control of the parallel link mechanism 14 by target position input, the stroke of the thrust jacks 14*a* to 14*f* along a quadratic Bézier curve can be controlled by computing this Bézier curve in which there are three control points: the target position, the articulation position, and the rear section position.

Next, in step S18, actual excavation proceeds while the thrust jacks 14*a* to 14*f* are controlled on the basis of the Bézier curve found in step S17.

With the boring machine 10 in this exemplary embodiment, even when excavation is performed while making fine adjustments while receiving manual control inputs from the operator, the above control method allows the articulation point Px and the center position P2 of the forward section 11 (which will be the target position) to be computed from the center line C1 and the center position P1 of the rear section 13, and allows excavation to proceed along a Bézier curve in which there are three control points, namely, the positions P1, P2, and Px.

Consequently, when performing excavation that includes a curve, the calculation of the target values for servo control of the thrust jacks 14*a* to 14*f* can be easily carried out geometrically, so excavation can be performed along a smooth curve with just simple control inputs.

Tunnel Excavation Method

The method for excavation with the boring machine 10 pertaining to this exemplary embodiment will now be described through reference to FIG. 7.

In this exemplary embodiment, a shaft is excavated as follows by controlling the above-mentioned boring machine 10.

Figure 7:
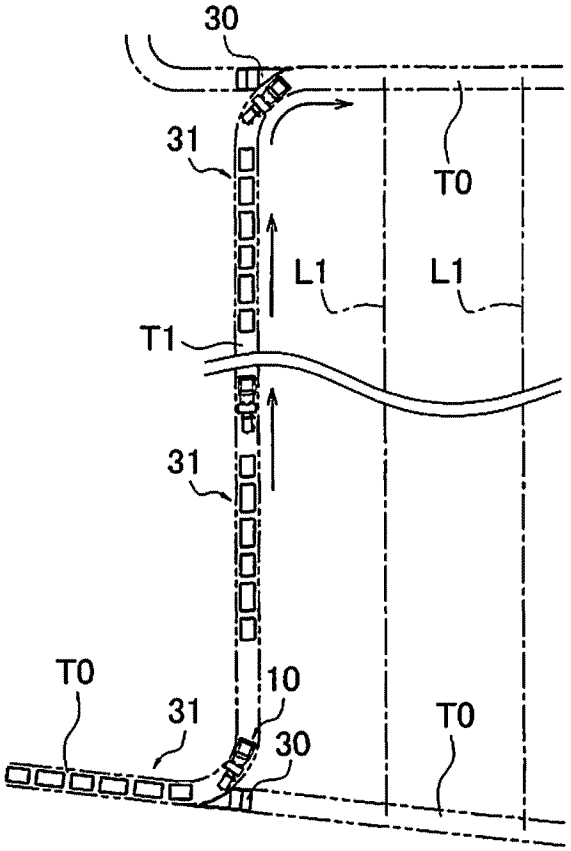
FIG. 7 is a diagram of the procedure for shaft excavation using the tunnel boring device in FIG. 1.

FIG. 7 shows the procedure for excavating three first tunnels T1 along three first boring lines L1 that are substantially parallel to one another, from two existing tunnels T0.

In FIG. 7, the boring machine 10 is equipped with a backup trailer 31 comprising a drive source for the boring machine 10, etc. The state shown here is one in which the boring machine 10 is moved by a tractor to a position that branches from an existing tunnel T0 to a first tunnel T1.

Here, a corner counterforce receiver 30 is installed at portions that branch off from an existing tunnel T0 to a first tunnel T1, where the radius of curvature R is smaller. Consequently, even at curved parts where the radius of curvature R is smaller because of branching off to the first tunnel T1, the boring machine 10 can continue to excavate the first tunnel T1 while the grippers 13*a* are in contact with the corner counterforce receivers 30.

Next, as shown in FIG. 7, the boring machine 10 and the backup trailer 31 are moved while the rock, etc., is excavated by the boring machine 10, along the first excavation line L1. This allows the first tunnel T1 to be formed at the desired location.

Next, when the excavation is completed up to the existing tunnel T0 formed some distance away, and the first tunnel T1 communicates between the two tunnels T0, the boring machine 10 and the backup trailer 31 are backed up by the tractor and returned to their initial locations.

The corner counterforce receivers 30 are installed at portions where the first tunnel T1 meets up with a tunnel T0.

Next, the boring machine 10 is again moved along a first excavation line L1 in order to excavate another first tunnel T1 that is substantially parallel to the first tunnel T1 just excavated.

Next, this procedure is repeated until three first tunnels T1 that are substantially parallel to each other have been excavated.

Consequently, with the boring machine 10 of this exemplary embodiment, even when excavating a shaft that includes a curved part with a smaller radius of curvature R, the method for controlling the boring machine 10 discussed above allows the excavation to be performed along a smooth curve by simple control inputs.

An exemplary embodiment of the present invention was described above, but the present invention is not limited to or by the above exemplary embodiment, and various modifications are possible without departing from the gist of the invention.

In the above exemplary embodiment, an example was given in which the boring machine 10 was equipped with the parallel link mechanism 14, which included the six thrust jacks 14*a* to 14*f*. However, the present invention is not limited to this. The number of thrust jacks constituting the parallel link mechanism may be eight, ten, or some other number, so long as it is greater than six.

In the above exemplary embodiment, an example was given in which a touch panel type of monitor display screen 50 was used as the interface for receiving control inputs from the operator, but the present invention is not limited to this. For instance, instead of using a touch panel type of monitor, control inputs may be performed with a keyboard, a mouse, or the like while looking at an ordinary PC screen.

In the above exemplary embodiment, an example was given in which various control components (the forward and reverse excavation setting component 51, the direction input component 52, the jack control component 53, and the deviation amount display component 54) were disposed on the monitor display screen 50, but the present invention is not limited to this. For instance, some other display mode may be employed for displaying on the monitor display screen.

In the above exemplary embodiment, an example was given in which a quadratic Bézier curve, which is a parametric curve, was used as the curve that is produced, but the present invention is not limited to this. For instance, a spline curve may be used as a parametric curve.

With the tunnel boring device of the present invention, even when tunnel excavation is performed by manual operation, excavation including curved portions can be performed by a simple operation, which means that this device can be widely applied to boring machines that perform tunnel boring.

The invention claimed is:

1. A tunnel boring device, comprising:

a forward section having a plurality of cutters at an excavation-side surface;

a rear section disposed to a rear side of the forward section and having grippers for obtaining counterforce during excavation;

a parallel link mechanism including a plurality of thrust jacks that are disposed in parallel between the forward section and the rear section and link the forward section and the rear section together, the parallel link mechanism being configured to change a position and orientation of the forward section with respect to the rear section;

an input component configured to receive a control input related to a movement direction of the forward section from an operator;

a computer configured to compute a position of an articulation point on the basis of the control input received by the input component, positions of a center line and a center point of the rear section, and a position of a center point of the forward section, the articulation point being a hypothetical point disposed between the forward section and the rear section; and a jack controller configured to control a stroke of each of the plurality of thrust jacks included in the parallel link mechanism so that the forward section moves forward along a curve generated from the positions of the center point of the rear section, the articulation point, and the center point of the forward section.

2. The tunnel boring device according to claim 1, wherein the jack controller controls the plurality of thrust jacks so that excavation is performed along a desired radius of curvature R set on the basis of the control input when the input component receives the control input from the operator.

3. The tunnel boring device according to claim 2, wherein the jack controller controls an attitude of the forward section three-dimensionally.

4. The tunnel boring device according to claim 2, further comprising a plurality of stroke sensors that are provided to the plurality of thrust jacks to sense an attitude of the forward section with respect to the rear section.

5. The tunnel boring device according to claim 2, wherein the input component is a touch panel type of monitor.

6. The tunnel boring device according to claim 5, wherein the monitor has a plurality of directional keys for setting a movement direction of the forward section, and a display component configured to display an amount of deviation between the current position and the target position.

7. The tunnel boring device according to claim 1, wherein the jack controller controls an attitude of the forward section three-dimensionally.

8. The tunnel boring device according to claim 1, further comprising a plurality of stroke sensors that are provided to the plurality of thrust jacks to sense an attitude of the forward section with respect to the rear section.

9. The tunnel boring device according to Claim 1, wherein the input component is a touch panel type of monitor.

10. The tunnel boring device according to claim 9, wherein the monitor has a plurality of directional keys for setting a movement direction of the forward section, and a display component configured to display an amount of deviation between the current position and the target position.

11. A method for controlling a tunnel boring device comprising a forward section, a rear section disposed to a rear of the forward section, and a parallel link mechanism including a plurality of thrust jacks that are disposed in parallel between the forward section and the rear section, the method comprising the steps of:

receiving a control input related to a movement direction of the forward section from an operator;

computing a position of an articulation point on the basis of positions of a center line and a center point of the rear section and a center point of the forward section, the articulation point being a hypothetical point disposed between the forward section and the rear section; and controlling a stroke of the thrust jacks included in the parallel link mechanism so that the forward section moves forward along a curve generated from the positions of the center point of the rear section, the articulation point, and the center point of the forward section.

12. A method for controlling a tunnel boring device comprising a rear section and a forward section having a cutter head and linked to the rear section to allow a relative position and orientation of the forward section with respect to the rear section to be changed, the method comprising the steps of:

finding a position of the forward section with respect to a position of the rear section;

computing a position of an articulation point, which is an intersection between a center line of the forward section and a center line of the rear section;

generating a curve that smoothly connects a position of the forward section, a position of the articulation point, and a position of the rear section; and moving the forward section with respect to the rear section along the curve.

* * * * *